US005992028A

United States Patent [19]

Wing

[11] Patent Number: 5,992,028

[45] **Date of Patent: *Nov. 30, 1999**

[54] PIN FOR POSITIVELY ALIGNING DOORS ON CABINETS

[75] Inventor: Forrest Wing, Des Moines, Iowa

[73] Assignee: Amana Company, L.P., Houston, Tex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/752,156

[22] Filed: Nov. 18, 1996

[51] Int. Cl.[6] ..... E05D 7/00

[52] U.S. Cl. ..... 33/194; 33/613; 16/254; 16/387

[58] Field of Search ..... 33/194, 197, 613, 33/645, 667; 16/254, 387; 411/508; 312/293.1, 326, 329; 49/397, 381

[56] References Cited

U.S. PATENT DOCUMENTS

| | | | |
|---|---|---|---|
| 1,540,991 | 6/1925 | Holmgren | 33/194 |
| 1,768,793 | 7/1930 | Sheard | 49/381 |
| 3,078,585 | 2/1963 | Dearborn | 33/667 |
| 3,290,109 | 12/1966 | Vanegas | 312/326 |
| 3,662,429 | 5/1972 | Johnson et al. | 49/381 |
| 4,862,598 | 9/1989 | Barlow et al. | 33/613 |
| 4,969,273 | 11/1990 | Richards | 33/667 |
| 4,977,683 | 12/1990 | Harder | 33/623 |
| 5,008,975 | 4/1991 | Wang et al. | 16/254 |
| 5,233,870 | 8/1993 | Peroni | 411/508 |
| 5,666,764 | 9/1997 | Beatty et al. | 16/254 |

FOREIGN PATENT DOCUMENTS

| | | | |
|---|---|---|---|
| 271596 | 3/1914 | Germany | 33/194 |
| 2192666 | 1/1988 | United Kingdom | 16/254 |

*Primary Examiner*—G. Bradley Bennett
*Attorney, Agent, or Firm*—Tobor, Goldstein & Henley, L.L.P.

[57] ABSTRACT

An enclosure has a door, a cabinet, an aligning pin attached to the cabinet, and a door hinge removably attached to the cabinet. The door hinge is arranged to receive the aligning pin so as to positively align the door hinge on the cabinet, and the door hinge is arranged to mount the door in opened and closed positions to the cabinet. The aligning pin may be directionally biased in order to mate with a directionally biased recess in the door hinge. The aligning pin may be a pair of pins to mate with a correspondingly pair of recesses in the door hinge.

15 Claims, 3 Drawing Sheets

FIG. 1
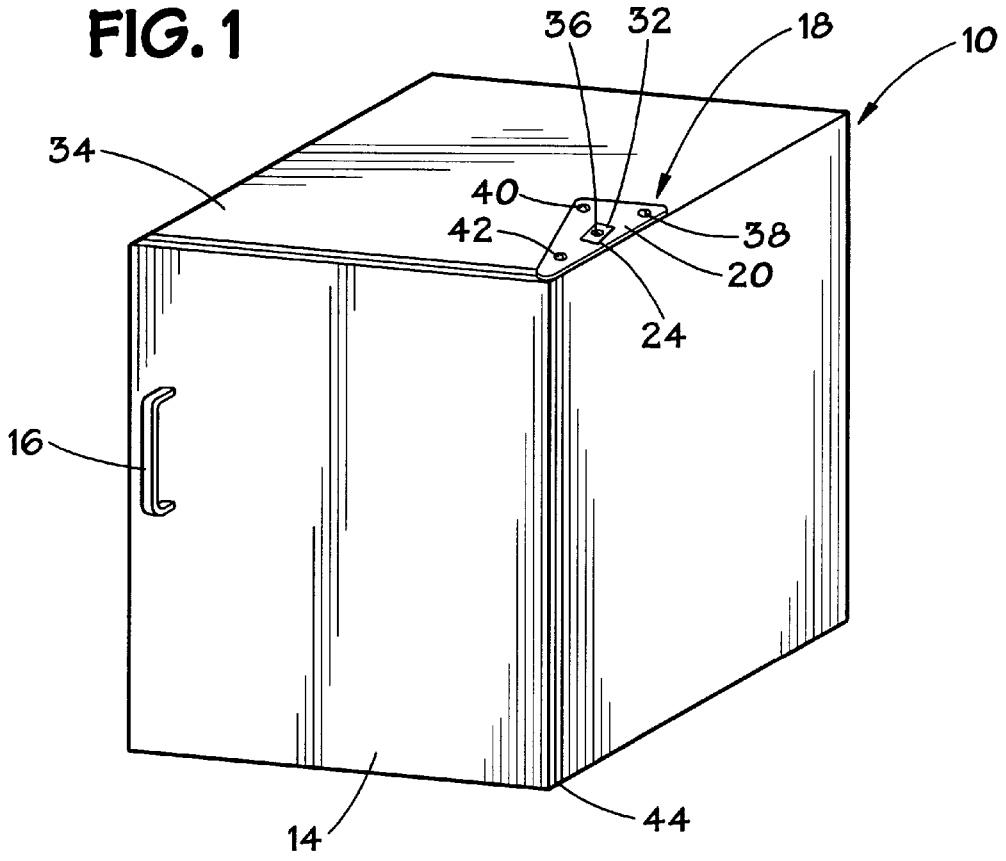
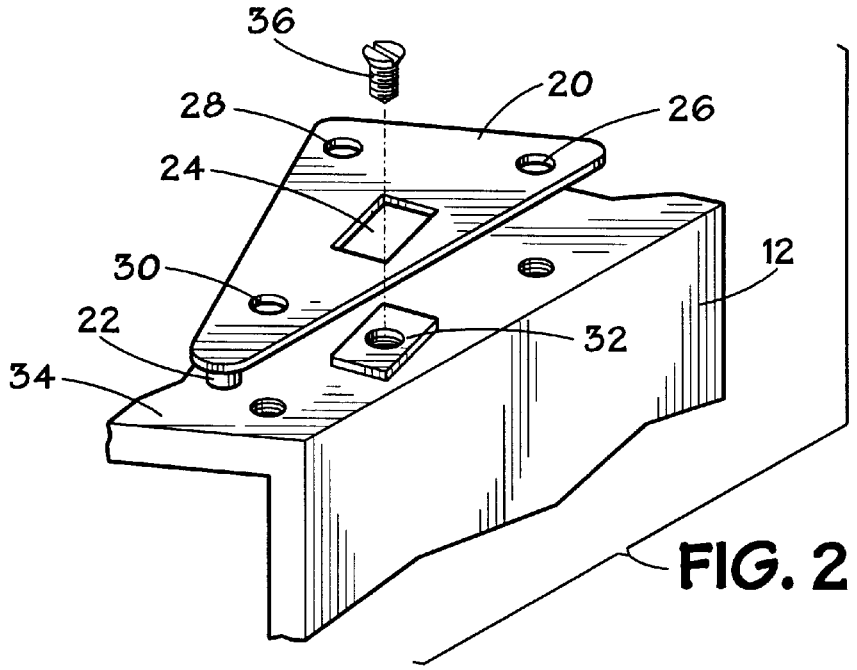
FIG. 2

FIG. 3
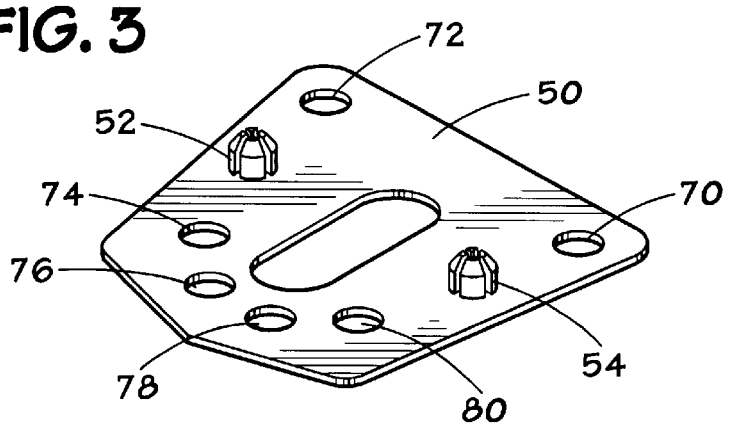
FIG. 4
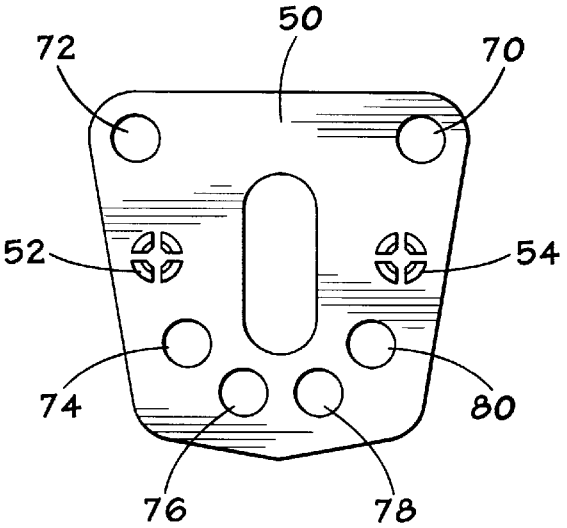
FIG. 5
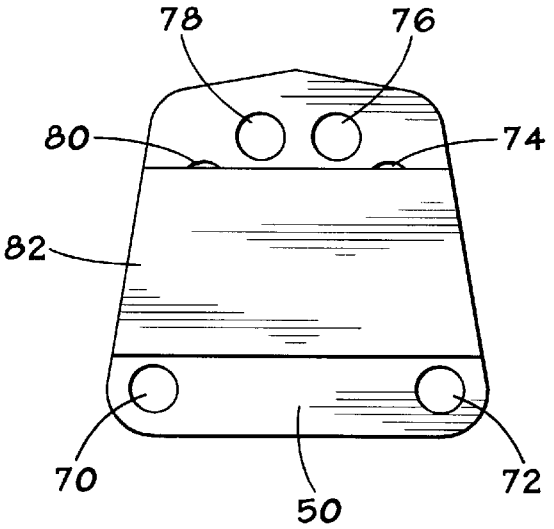
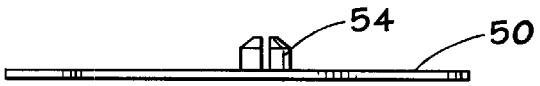
FIG. 6

PIN FOR POSITIVELY ALIGNING DOORS ON CABINETS

TECHNICAL FIELD OF THE INVENTION

The present invention is directed to a door alignment pin for correctly aligning doors onto cabinets.

BACKGROUND OF THE INVENTION

Door hinges are typically used to mount a door, particularly a swinging door, onto a cabinet. Such door hinges permit the door to be swung open in order to allow access to the contents of the cabinet. If the door hinges are not precisely positioned on the cabinet, the door will not align properly with the cabinet. If the door is not properly aligned on the cabinet, movement of the door may be obstructed. Also, a misaligned door is not aesthetically pleasing. To avoid these problems, a cabinet builder employs fixturing equipment in order to precisely position the door hinges on the cabinet so that, when the door is installed on the door hinges, the door properly aligns with the cabinet. The cabinet builder typically ships the cabinet with its door mounted thereon.

Following shipment, there may be occasions where the door and door hinges are removed from the cabinet. For example, an installer usually removes the door hinges and door from the base of a cabinet in order to install the cabinet. Following installation of the cabinet base, the installer reattaches the door hinges and door. As another example, a repairer frequently removes the door hinges and door from a cabinet in order to repair the cabinet. Following completion of the repair, the repairer reattaches the door hinges and door.

However, because the installer or repairer does not have the cabinet builder's fixturing equipment, the installer or repairer must iteratively reposition the door and door hinges on the cabinet until proper alignment of the door to the cabinet is achieved. This iterative process is painstaking and requires a substantial amount of time to complete which adds to the cost of installation or repair.

In addition, there may be a tendency for a door to become misaligned on its cabinet through repeated openings and closings of the door.

The present invention is directed to an arrangement which solves one or more of the above noted problems.

SUMMARY OF THE INVENTION

According to a first aspect of the present invention, a door hinge alignment arrangement comprises an aligning means and an attaching means. The aligning means positively aligns a door hinge on a cabinet. The attaching means attaches the aligning means to the cabinet so that, when the door hinge is mounted to the cabinet, the door hinge is aligned to the cabinet by the aligning means.

According to another aspect of the present invention, a hinge arrangement comprises a hinging means and an aligning means. The hinging means hinges a door to a cabinet, and the hinging means is arranged to be removably attached to the cabinet. The aligning means positively aligns the hinging means on the cabinet, and the aligning means is arranged to remain attached to the cabinet in the event that the hinging means is removed.

According to yet another aspect of the present invention, a hinge arrangement comprises a hinge, an aligning pin, and first and second fasteners. The hinge is arranged to hinge a door to a cabinet. The aligning pin is arranged to positively align the hinge on the cabinet. The first fastener is arranged to fasten the aligning pin to the cabinet. The second fastener is arranged to fasten the hinge to the cabinet so that the hinge is aligned to the cabinet by the aligning pin.

According to still another aspect of the present invention, an enclosure comprises a door, a cabinet, an alignment pin attached to the cabinet, and a removable door hinge attached to the cabinet. The removable door hinge is arranged to receive the alignment pin so as to positively align the removable door hinge on the cabinet, the alignment pin is arranged to remain attached to the cabinet in the event that the removable door hinge is removed therefrom, and the removable door hinge is arranged to mount the door in opened and closed positions to the cabinet.

BRIEF DESCRIPTION OF THE DRAWINGS

These and other features and advantages of the present invention will become more apparent from a detailed consideration of the invention when taken in conjunction with the drawings in which:

FIG. 1 is an isometric view of a door and cabinet arrangement having a door hinge and having a first embodiment of a door alignment pin according to the present invention;

FIG. 2 is an exploded isometric view of the door hinge and the door alignment pin of FIG. 1;

FIG. 3 is an isometric view of a door alignment pin according to a second embodiment of the present invention;

FIG. 4 is a top view of the door alignment pin shown in FIG. 3;

FIG. 5 is a bottom view of the door alignment pin shown in FIG. 3;

FIG. 6 is a side view of the door alignment pin shown in FIG. 3;

DETAILED DESCRIPTION

Figure 7:
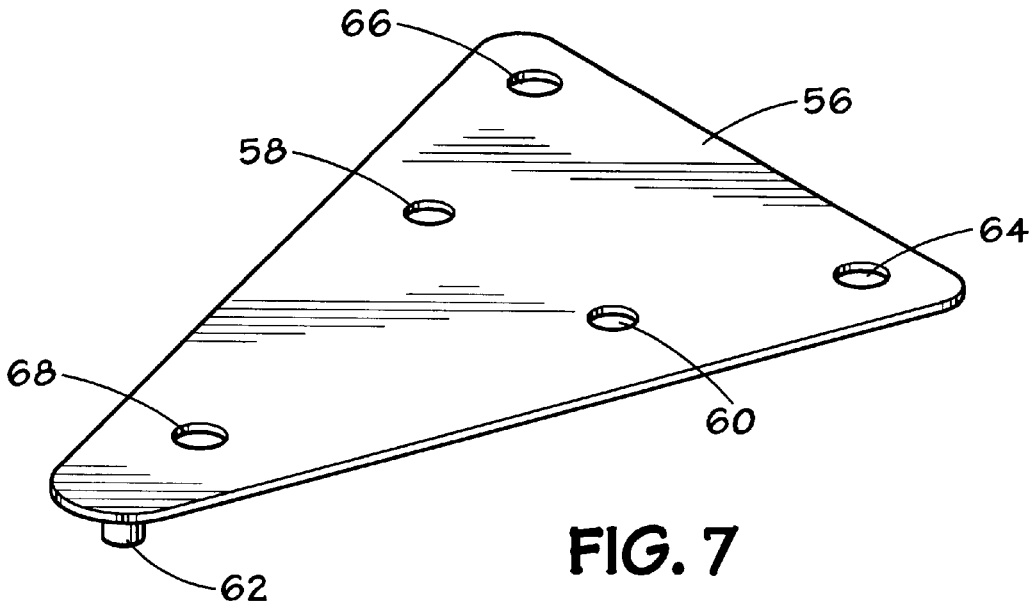
FIG. 7 is a door hinge to be used in conjunction with the door alignment pin of FIG. 3.

An enclosure 10 is illustrated in FIG. 1 and includes a cabinet 12 and a door 14. The cabinet 12 houses an interior space within which items may be stored, and the door 14 has a handle 16. A hinge 18 between the cabinet 12 and the door 14 permits the door 14 to be swung open by use of the handle 16 in order to permit access to the contents of the cabinet 12, and to be swung closed in order to conceal the contents of the cabinet 12 from view. The cabinet 12 may be a refrigerator cabinet, an appliance cabinet, a storage cabinet, a pantry, and/or the like.

As illustrated in FIGS. 1 and 2, the hinge 18 includes a hinge plate 20 and a hinge pin 22. The hinge pin 22 mates with a corresponding recess in the door 14 in order to provide a pivot point for the door 14 with respect to the cabinet 12. Accordingly, the door 14 may be swung opened and closed about this pivot point. The hinge plate 20 has a pin receiving recess 24, which may extend entirely through the hinge plate 20, and three fastener receiving holes 26, 28, and 30. The pin receiving recess 24, as shown in FIGS. 1 and 2, has a rectangular shape.

An aligning pin 32 is attached to a top surface 34 of the cabinet 12 by a fastener 36. The fastener 36 may be a screw, a bolt, or the like. However, instead of fastening the aligning pin 32 on the top surface 34 of the cabinet 12 by use of a screw, bolt, or the like, the aligning pin 32 may be fastened to the top surface 34 of the cabinet 12 by use of an adhesive such as double-sided adhesive tape, glue, or the like, or by the use of other fastening mechanisms.

The aligning pin 32 has a rectangular shape matching the rectangular shape of the pin receiving recess 24. Because the shape of the aligning pin 32 is rectangular, the aligning pin 32 is directionally biased. Similarly, because the shape of the pin receiving recess 24 is rectangular, the hinge plate 20 is directionally biased. Accordingly, when the aligning pin 32 is fastened to the cabinet 12 by the fastener 36, and when the hinge plate 20 is to be mounted to the cabinet 12 so that the aligning pin 32 fits into the pin receiving recess 24, the hinge plate 20 may be oriented on the cabinet 12 in only a limited number of directions. The preferred orientation of the hinge plate 20 is readily apparent based upon the required position of the hinge pin 22 in relation to the door 14.

When the hinge 18 is to be mounted to the cabinet 12 by a cabinet builder, the cabinet builder uses fixturing equipment to align the hinge plate 20 and the aligning pin 32 on the cabinet 12. When the correct alignment of the hinge plate 20 is achieved, the aligning pin 32 is fastened by use of the fastener 36 to the top surface 34 of the cabinet 12. Then, the hinge plate 20 is fastened to the cabinet 12 by use of fasteners 38, 40, and 42. These fasteners are inserted through the corresponding fastener receiving holes 26, 28, and 30 of the hinge plate 20 while the aligning pin 32 is seated into the pin receiving recess 24. The fasteners 38, 40, and 42 may be screws, bolts, or the like. Accordingly, because the aligning pin 32 is directionally biased and properly fixed to the cabinet 12, the hinge plate 20 will also be properly positioned on the cabinet 12.

A second hinge, similar to the hinge 18, may be placed at a location 44 on the cabinet 12. This second hinge may be the mirror image of the hinge 18. Accordingly, pivot points are provided for the top and the bottom of the cabinet door 14.

As indicated above, the cabinet builder typically ships the enclosure 10 with the door 14 mounted to the cabinet 12 by use of the hinge 18 and the second hinge at the location 44. During installation of the enclosure 10, an installer usually removes the hinge plate 20 of the hinge 18 in order to remove the door 14. The installer then installs the cabinet 12 and reattaches the hinge plate 20 and the door 14 to the cabinet 12. Because of the aligning pin 32, the hinge plate 20 of the hinge 18 is precisely positioned by the installer with respect to the cabinet 12 so that, when the door 14 is attached to the hinge plate 20, the door 14 is precisely aligned on the cabinet 12 in accordance with the position established by the cabinet builder. No iterative repositioning of the hinge 18 is required in order to properly position the door 14 on the cabinet 12. The aligning pin 32 also permits non-iterative re-attachment and alignment of the door 14 to the cabinet 12 by a repairer if the repairer is required to take the door 14 off of the cabinet 12 in order to repair the cabinet 12 and/or the door 14.

FIGS. 3–6 illustrate a second embodiment of the present invention. In this embodiment, an alignment plate 50 has a pair of aligning split pins 52 and 54. The alignment plate 50 and the aligning split pins 52 and 54 may be formed as a one-piece unit by molding, extrusion, or the like. The aligning split pins 52 and 54 have four lobes as shown in FIGS. 3 and 4. However, these aligning split pins 52 and 54 may have any number of lobes. For example, the aligning split pins 52 and 54 may have two, three, or more lobes.

A hinge plate 56, which is arranged to accommodate the aligning split pins 52 and 54 of the alignment plate 50, is illustrated in FIG. 7. The hinge plate 56 has a pair of pin receiving recesses 58 and 60. The pin receiving recesses 58 and 60 may be holes through the hinge plate 56 and may be arranged to receive the aligning split pins 52 and 54 of the alignment plate 50. The splits in the aligning split pins 52 and 54 allow the aligning split pins 52 and 54 to yield as they protrude into the pin receiving recesses 58 and 60 so as to result in a firm friction fit between the aligning split pins 52 and 54 and the hinge plate 56.

Because the alignment plate 50 has two aligning split pins 52 and 54, the alignment plate 50 is directionally biased. Similarly, because the hinge plate 56 has two pin receiving recesses 58 and 60, the hinge plate 56 is directionally biased.

The hinge plate 56 also has a hinge pin 62 extending therefrom which fits into a recess in the door 14 in order to provide a pivot point between the door 14 and the cabinet 12. The hinge plate 56 has fastener receiving holes 64, 66, and 68 therethrough for receiving fasteners in order to fasten the hinge plate 56 to the cabinet 12.

Similarly, the alignment plate 50 has a plurality of fastener receiving holes 70, 72, 74, 76, 78, and 80 which are arranged to accommodate the fasteners inserted through the fastener receiving holes 64, 66, and 68 in the hinge plate 56 when the hinge plate 56 is fastened to a surface of a cabinet. A fastener 82 is provided on a bottom surface of the alignment plate 50. The fastener 82 may be double-sided adhesive tape, glue, or a similar adhesive.

In preparation for mounting the door 14 to the cabinet 12, a cabinet builder precisely positions the alignment plate 50 on the cabinet 12. During this process, the cabinet builder may use fixturing equipment as discussed above. The fastener 82 is used in order to fixedly attach the alignment plate 50 to the cabinet. The hinge plate 56 is mounted to the alignment plate 50 so that the aligning split pins 52 and 54 of the alignment plate 50 protrude into the pin receiving recesses 58 and 60 of the hinge plate 56. Fastening devices, such as screws, bolts, or the like, are inserted through the fastener receiving holes 64, 66, and 68 in the hinge plate 56 and through the corresponding fastener receiving holes 70, 72, 74, 76, 78, and/or 80 in the alignment plate 50 in order to fasten the hinge plate 56 to the cabinet. The door 14 is then mounted to the hinge plate 56 so that a recess of the door 14 receives the hinge pin 62. A second hinge plate, corresponding to the hinge plate 56, is also precisely positioned on the cabinet 12 in cooperation with an alignment plate similar to the alignment plate 50 so that its hinge pin is received by a corresponding recess of the door 14.

Accordingly, as before, when an installer or repairer removes the door 14 and the hinge plate 56 from the cabinet 12, the alignment plate 50 remains secured to the cabinet 12 because of the fastener 82. Accordingly, the installer or repairer is able to use the alignment plate 50 in order to reattach the hinge plate 56 and the door 14 to the cabinet 12 so that the door 14 is precisely positioned on the cabinet 12 in the position established by the cabinet builder. Also, because of the alignment plate 50, iterative repositioning of the door 14 on the cabinet 12 to accomplish precise alignment is avoided.

Figure 8:
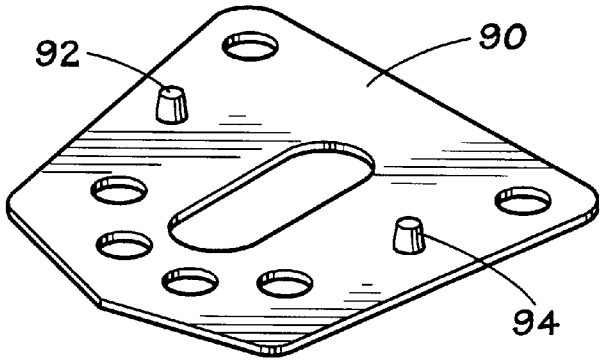
FIG. 8 is an isometric view of a door alignment pin according to a third embodiment of the present invention; and, FIG. 9 is a side view of the door alignment pin shown in FIG. 8.
Figure 9:
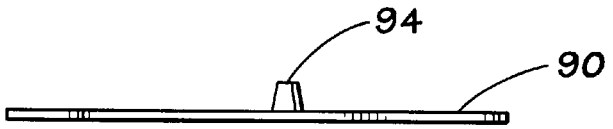

A third embodiment of the present invention is illustrated in FIGS. 8 and 9. According to this embodiment, an alignment plate 90 has a pair of aligning pins 92 and 94 thereon. The alignment plate 90 and the aligning pins 92 and 94 may be a one-piece device formed by molding, extrusion, or the like. Because the alignment plate 90 has two aligning pins 92 and 94, the alignment plate 90 is directionally biased. As may be understood by comparing the alignment plates 50 and 90, the alignment plate 90 is similar to the alignment plate 50 differing principally in that the aligning pins 92 and 94 are not split pins but are instead whole pins. The aligning pins 92 and 94 may also be somewhat tapered in order to facilitate mating with the pin receiving recesses 58 and 60 of the hinge plate 56. As in the case of the alignment plate 50, the alignment plate 90 may be mounted to a surface of a cabinet by use of the fastener 82.

Certain modifications of the present invention have been discussed above. Other modifications will occur to those practicing in the art of the present invention. For example, as described above, the aligning pin 32 and the pin receiving recess 24 of the hinge plate 20 are rectangular. However, the aligning pin 32 and the pin receiving recess 24 of the hinge plate 20 may instead be generally polygonal, may be oblong, or may have any other shape which is directionally biased in order to position the hinge plate 20 in a preferred orientation with respect to the cabinet 12.

Also, because the aligning pin 32 and the pin receiving recess 24 of the hinge plate 20 are rectangular, the aligning pin 32 and the pin receiving recess 24 have two possible orientations with respect to each other. However, the shape of the aligning pin 32 and the pin receiving recess 24 may be arranged so that they have only one possible orientation with respect to one another other. For example, the aligning pin 32 and the pin receiving recess 24 may be trapezoidal.

Moreover, because the alignment plate 50 has two aligning split pins 52 and 54 which cooperate with the two pin receiving recesses 58 and 60 of the hinge plate 56, the alignment plate 50 and the hinge plate 56 have two possible orientations with respect to each other. However, the number and placement of the aligning split pins 52 and 54 and the pin receiving recesses 58 and 60 may be arranged so that the alignment plate 50 and the hinge plate 56 have only one possible orientation with respect to one another other. For example, the alignment plate 50 may have three aligning split pins at the apexes of a non-equilateral triangle to correspond to three pin receiving holes in the hinge plate 56 which are also at the apexes of the same non-equilateral triangle.

Similarly, the number and placement of the aligning pins 92 and 94 may be arranged so that the alignment plate 90 and the hinge plate 56 have only one possible orientation with respect to one another other.

Furthermore, as described above, an alignment plate and its aligning pins may be formed as a one-piece unit. However, an alignment plate and its aligning pins need not be formed as a one-piece unit. Instead, for example, the alignment pins may be rivets or other projections suitably attached to a corresponding alignment plate.

Accordingly, the description of the present invention is to be construed as illustrative only and is for the purpose of teaching those skilled in the art the best mode of carrying out the invention. The details may be varied substantially without departing from the spirit of the invention, and the exclusive use of all modifications which are within the scope of the appended claims is reserved.

What is claimed is:

1. A refrigerator door hinge assembly for fastening a hinge to a refrigerator cabinet, the refrigerator cabinet having an outer surface, comprising:

a hinge plate, having at least one fastener receiving hole formed therein for receiving at least one separate hinge plate fastener to fasten the hinge plate to the outer surface of the cabinet, the hinge plate having at least one directionally biased alignment device receiving recess formed therein;

an alignment device, including at least one directionally biased alignment protrusion, the alignment device having a separate alignment device fastener for fastening the alignment device directly to the outer surface of the cabinet; and the at least one directionally biased alignment protrusion being matingly received within the at least one directionally biased alignment device receiving recess formed in the hinge plate.

2. The refiigerator door hinge assembly of claim 1, wherein the hinge plate and alignment device are separately fastened to the cabinet surface.

3. The refrigerator door hinge assembly of claim 1, wherein the at least one directionally biased alignment protrusion is a pin having a directionally biased shape which is matingly received within the directionally biased alignment device receiving recess formed in the hinge plate.

4. The refrigerator door hinge assembly of claim 3, wherein the directionally biased shape of the pin is a rectangle.

5. The refrigerator door hinge assembly of claim 1, wherein the at least one directionally biased alignment protrusion is a pair of pins which are matingly received within a corresponding pair of directionally biased alignment devices receiving recesses formed in the hinge plate.

6. The refrigerator door hinge assembly of claim 1, wherein the at least one directionally biased alignment protrusion is a pair of split pins which are matingly received within a corresponding pair of directionally biased alignment device receiving recesses formed in the hinge plate.

7. The refrigerator door hinge assembly of claim 1, wherein the alignment device fastener comprises an adhesive.

8. A refrigerator door hinge assembly for fastening a hinge to a refrigerator cabinet, comprising:

a refrigerator door;

a refrigerator cabinet having an outer surface;

a refrigerator door hinge assembly including, a hinge plate, having at least one fastener receiving hole formed therein for receiving at least one separate hinge plate fastener to fasten the hinge plate to the outer surface of the cabinet, the hinge plate having at least one directionally biased alignment device receiving recess formed therein;

an alignment device, including at least one directionally biased alignment protrusion, the alignment device having a separate alignment device fastener for fastening the alignment device directly to the outer surface of the cabinet; and the at least one directionally biased alignment protrusion being matingly received within the at least one directionally biased alignment device receiving recess formed in the hinge plate.

9. The refrigerator of claim 8, wherein the hinge plate and alignment device are separately fastened to the cabinet surface.

10. The refrigerator of claim 8, wherein the at least one directionally biased alignment protrusion is a pin having a directionally biased shape which is matingly received within the directionally biased alignment device receiving recess formed in the hinge plate.

11. The refrigerator of claim 10, wherein the directionally biased shape of the pin is a rectangle.

12. The refrigerator of claim 8, wherein the at least one directionally biased alignment protrusion is a pair of pins which are matingly received within a corresponding pair of directionally biased alignment devices receiving recesses formed in the hinge plate.

13. The refrigerator of claim 8, wherein the at least one directionally biased alignment protrusion is a pair of split pins which are matingly received within a corresponding pair of directionally biased alignment device receiving recesses formed in the hinge plate.

14. The refrigerator of claim 8, wherein the alignment device fastener comprises an adhesive.

15. A method of fastening a hinge to a refrigerator cabinet, the refrigerator cabinet having an outer surface, comprising the steps of:

providing an alignment device having at least one directionally biased alignment protrusion;

providing a separate alignment device fastener for fastening the alignment device directly to the outer surface of the cabinet;

determining a location and orientation of the alignment device corresponding to a desired location and orientation of the hinge to be fastened to the outer surface of the cabinet;

fastening the alignment device to the outer surface of the cabinet with the separate alignment device fastener;

providing a hinge plate having at least one fastener receiving hole formed therein and having at least one directionally biased alignment device receiving recess formed therein;

orienting the hinge plate so that the directionally biased alignment device receiving recess matingly receives the at least one directionally biased alignment device protrusion; and thereafter, providing at least one separate hinge plate fastener and fastening the hinge plate directly to the outer surface of the cabinet with the at least one separate hinge plate fastener, without fastening the hinge plate to the alignment device.

* * * * *